US006903692B2

(12) United States Patent
Kivekäs et al.

(10) Patent No.: US 6,903,692 B2
(45) Date of Patent: Jun. 7, 2005

(54) DIELECTRIC ANTENNA

(75) Inventors: Outi Kivekäs, Espoo (FI); Jani Ollikainen, Helsinki (FI); Jaakko Juntunen, Espoo (FI); Pertti Vainikainen, Helsinki (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/156,356

(22) Filed: May 28, 2002

(65) Prior Publication Data

US 2002/0180646 A1 Dec. 5, 2002

(30) Foreign Application Priority Data

Jun. 1, 2001 (FI) ..... 20011148

(51) Int. Cl.[7] ..... H01Q 1/40
(52) U.S. Cl. ..... 343/702; 343/911 R
(58) Field of Search ..... 343/702, 911 R, 343/700 MS

(56) References Cited

U.S. PATENT DOCUMENTS

| | | | | |
|---|---|---|---|---|
| 5,097,237 A | * | 3/1992 | Komazaki et al. | 333/204 |
| 5,453,754 A | * | 9/1995 | Fray | 343/789 |
| 6,198,450 B1 | | 3/2001 | Adachi et al. | 343/753 |
| 6,388,626 B1 | * | 5/2002 | Gamalielsson et al. | 343/702 |

FOREIGN PATENT DOCUMENTS

| | | | |
|---|---|---|---|
| EP | 0 587 247 A1 | 3/1994 | |
| EP | 0 766 340 A2 | 4/1997 | |
| FI | 19991929 | 10/1999 | H01Q/1/24 |
| SE | 511 501 | 10/1999 | H01Q/1/24 |
| SE | 513 055 | 6/2000 | H01Q/1/24 |

OTHER PUBLICATIONS

Yung E.K.N., et al., "A Dielectric Resonator on a Microstrip Antenna", Antennas and Propagation Society International Symposium 1993, AP–S, Digest Ann Arbor, MI, USA, IEEE Jun. 28, 1993 pp. 1504–1507.

Chen Z.N., et al., "A new Inverted F Antenna with a Ring Dielectric Resonator", IEEE Transactions on Vehicular Technology, IEEE Inc., New York vol. 48, No. 4, Jul. 4, 1999, pp. 1029–1032.

Mongia R.K., "Reduced size metallized dielectric resonator antennas" Antennas and Propagation Society International Sumposium, 1997, IEEE, 1997 Digest Montreal, Quebec, Canada Jul. 13–18, 1997, New York, USA, IEEE, Uly 13, 1997, pp. 2202–2205.

* cited by examiner

*Primary Examiner*—James Vannucci
(74) *Attorney, Agent, or Firm*—Darby & Darby

(57) ABSTRACT

The invention relates to a dielectric antenna, particularly suited to portable radio devices. The feed conductor (231) of the antenna is shaped so that it at the same time in itself serves as a radiator in the same frequency range as the dielectric resonator (220) of the antenna. The resonance frequencies of the feed conductor and the dielectric resonator are advantageously arranged to be so near to each other that there is formed a united operation band. The feed conductor is advantageously located on a surface (223) of the dielectric element. The structure may also include parasitic conductors. For the antenna according to the invention, there is obtained a larger bandwidth than for corresponding antennas of the prior art. Moreover, the air gaps between the feed conductor and the dielectric element are avoided, as well as resulting changes in the electric properties.

24 Claims, 4 Drawing Sheets

DIELECTRIC ANTENNA

The invention relates to a dielectric antenna structure suited particularly for portable radio devices.

A dielectric antenna means a resonator where the substantial dielectric element is open on several sides, so that electromagnetic energy is freely emitted to the surroundings while the structure resonates. Dielectric antennas are advantageous at very high frequencies, because the conductor losses with them are small. In addition, they are small in size when compared with other structures that have similar electromagnetic properties.

The feeding of electromagnetic energy to a dielectric antenna can be arranged in several different ways. The inner conductor of a short coaxial feed line can be extended to inside the dielectric element. In that case the drawback is that even small air gaps left in between the feed conductor and the dielectric mass may remarkably change the resonance frequency and bandwidth of the antenna. For the feeding, there can be used an open end of a waveguide or another aperture radiator. The drawback of these is the relative complexity of their structure and resulting production costs. As a feed line there can also be used a transmission line formed of a microstrip on a circuit board and of a ground plane on the opposite side of the circuit board, so that the microstrip extends to underneath the dielectric element mounted on the circuit board. Even here, the drawback is the small air gaps that are easily left between the microstrip and the dielectric element.

Figure 1:
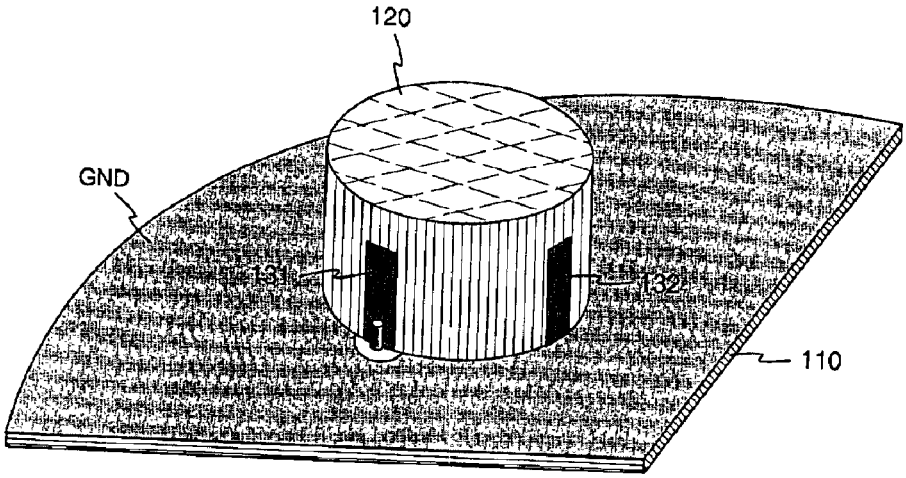
Fig. 1 PRIOR ART

Among others from the article "Use of parasitic strip to produce circular polarization and increased bandwidth for cylindrical dielectric resonator antenna" (ELECTRONICS LETTERS 29 Mar. 2001, Vol.37, No.7) there is known a feed arrangement of a dielectric antenna, where the microstrip used for the feeding is located directly on the surface of a dielectric element. This arrangement is illustrated in FIG. 1. There is shown a circuit board 110, on the top surface whereof there is the conductive ground plane GND. On top of the circuit board, there is mounted a cylindrical dielectric element 120, with one bottom against the ground plane. The dielectric coefficient of the dielectric material is for instance 13. The feed strip 131 is placed tightly on the side surface of the dielectric element, in parallel with the axis of the cylinder. The dimensions of the parts are designed so that when the feed strip is connected to a source with a given frequency, a resonance is generated in the dielectric element, and the structure functions as a radiator. In addition, on the side surface of the dielectric element, there is provided a parasitic second microstrip 132, which in the drawing is at the lower end connected to the ground plane. Owing to the effect of this second microstrip, there is obtained a second resonance frequency for the structure, which second resonance frequency can be arranged fairly near to the frequency of the above mentioned resonance, or further away therefrom, so that the respective bands are separate.

A common drawback with known dielectric antennas is their relatively small bandwidth. In a structure according to FIG. 1, the bandwidth can be increased by means of the second microstrip, but in practice the relative bandwidth is not increased much over ten percent.

The object of the invention is to alleviate said drawbacks connected to the prior art. Consequently, the dielectric antenna according to the invention is characterized by what is set forth in the independent claim 1. Preferred embodiments of the invention are described in the dependent claims.

The basic idea of the invention is as follows: The feed conductor of a dielectric antenna is shaped so that it at the same time in itself functions as a radiator within the same frequency range as the dielectric resonator. The resonance frequencies of the feed conductor and of the dielectric element are advantageously arranged so near to each other that there is formed a united operation band. The feed conductor is advantageously placed on a surface of the element. The structure may additionally include parasitic conductors.

An advantage of the invention is that for an antenna according to it, there is obtained a larger bandwidth than for corresponding antennas of the prior art. Moreover, it is an advantage of the structure according to the invention that there are avoided the air gaps between the feed conductor and the dielectric element as well as the resulting changes in the electric properties. Further, it is an advantage of the invention that the structure according to it is simple, and the production costs are fairly low.

Figure 2:
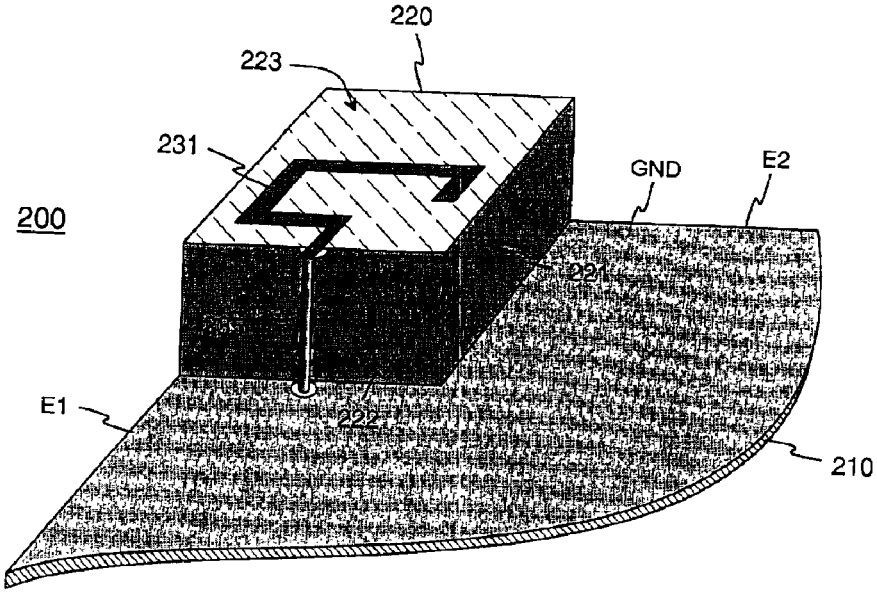
Figure 3:
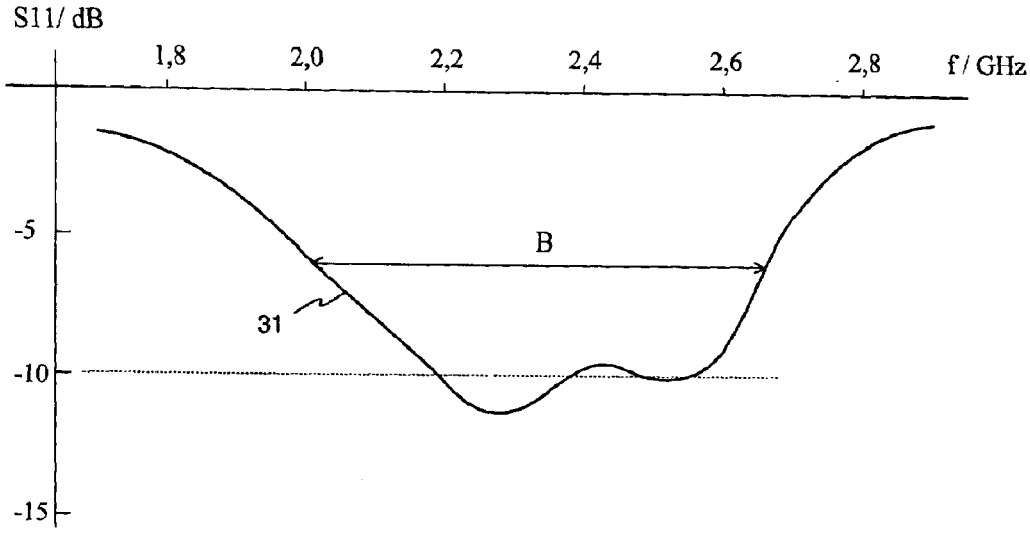
Figure 4:
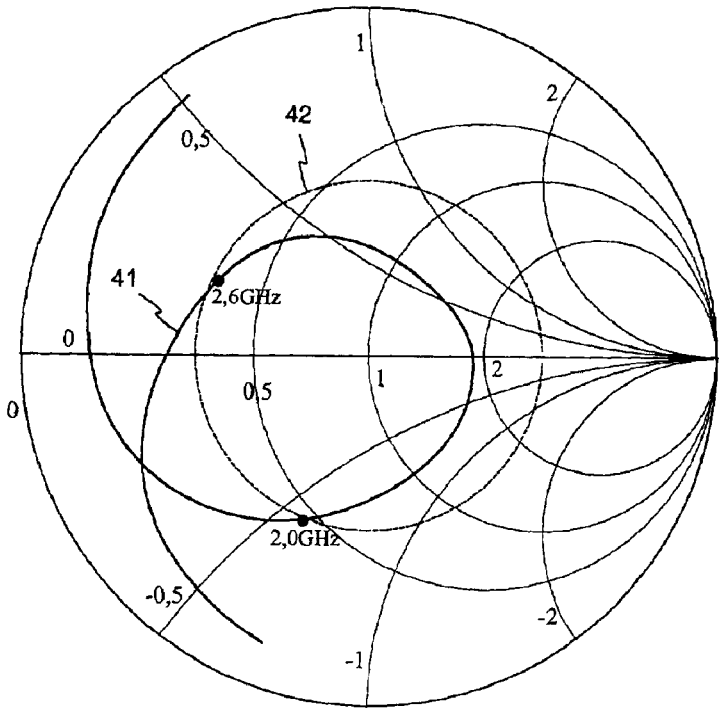
Figure 5A:
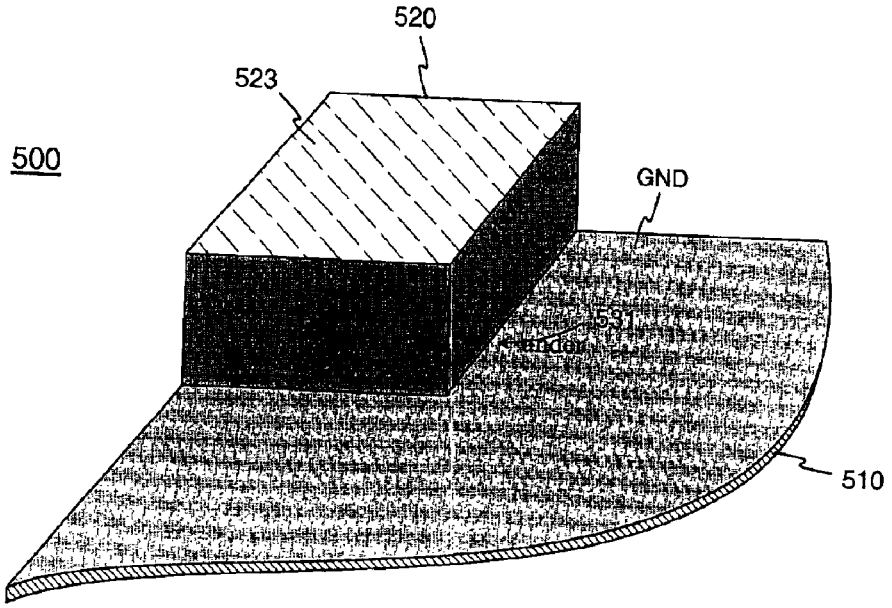
Figure 5B:
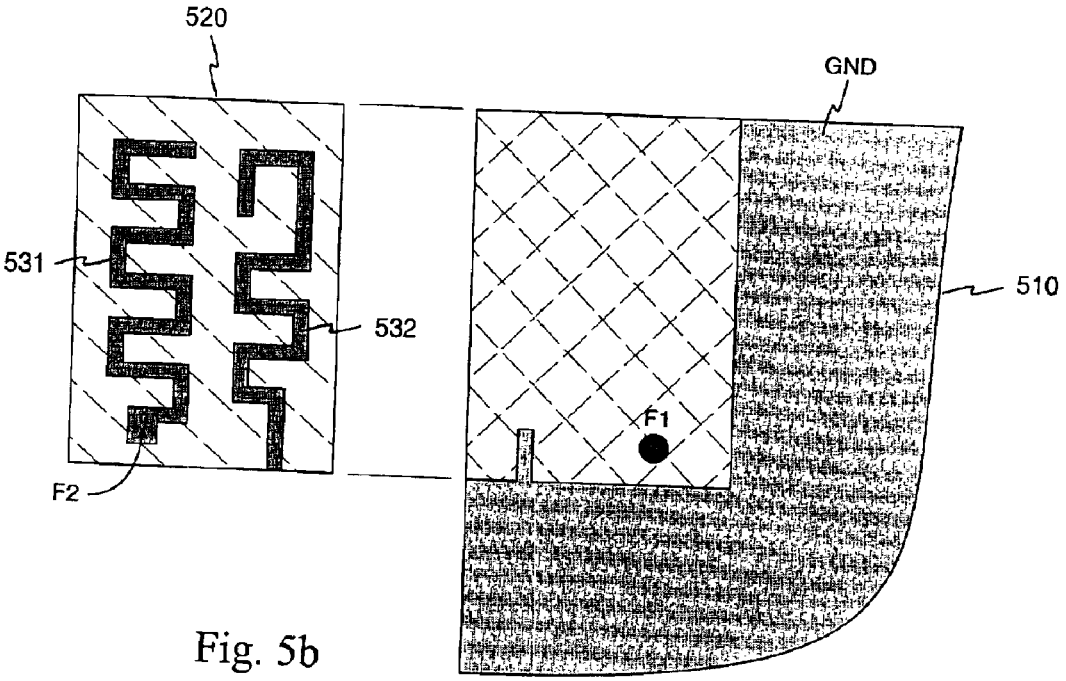
Figure 6:
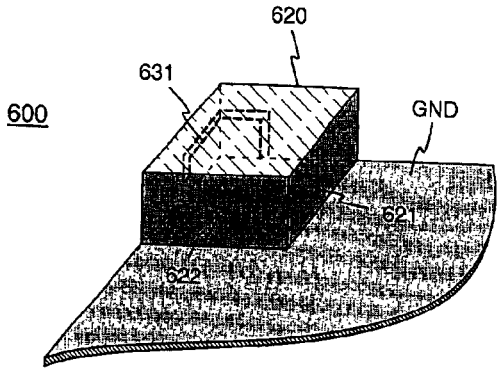
Figure 7:
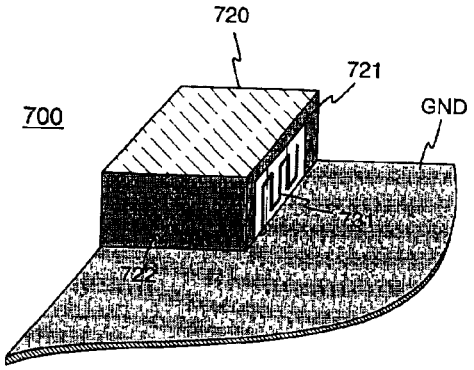
Figure 8:
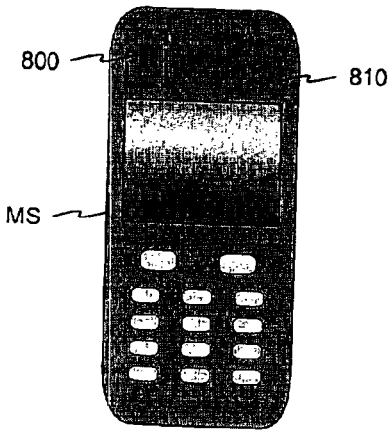

The invention is explained in more detail below, with reference to the appended drawings, where FIG. 1 illustrates an example of a dielectric antenna according to the prior art, FIG. 2 illustrates an example of a dielectric antenna according to the present invention, FIG. 3 illustrates an example of the band characteristics of the antenna according to FIG. 2, FIG. 4 illustrates an example of the reflection coefficient of the antenna according to FIG. 2, FIG. 5*a* illustrates another example of the dielectric antenna according to the invention, FIG. 5*b* illustrates the antenna of FIG. 5*a* as detached from the circuit board, FIG. 6 illustrates a third example of the antenna according to the invention, FIG. 7 illustrates a fourth example of the antenna according to the invention, and FIG. 8 illustrates an example of a device provided with an antenna according to the invention, FIG. 1 was already explained above, with reference to the description of the prior art.

FIG. 2 illustrates an example of the antenna structure according to the invention. The antenna structure 200 includes a ground plane GND on the top surface of a circuit board 210 and a dielectric element 220 having the shape of a rectangular prism placed in the corner of said circuit board. The dielectric element together with the ground plane forms a dielectric resonator. In this example, the first side surface 221 of the dielectric element, which side surface is parallel to the first edge E1 of the two edges forming said corner of the circuit board 210, but opposite to the side surface which is bordered by the edge E1 and perpendicular to the ground plane GND, is coated with a conductive layer connected to the ground plane. In similar fashion, the second side surface 222, which is parallel to the second edge E2 of the two edges forming said corner of the circuit board 210, but opposite to the side surface which is bordered by the edge E2 and perpendicular to the ground plane GND, is coated with a conductive layer connected to the ground plane. Now the shape of the electric field generated in the dielectric element in the resonant state resembles the shape of an electric field that would be generated in an element that is, viewed from said corner, wider in the direction of the conductive side surfaces, and has no the conductive side surfaces. This means that by means of the conductive side surfaces, the size of a resonator resonating at a given frequency can be reduced.

In the example of FIG. 2, the feed conductor 231 of the antenna is a strip-like conductor on the top surface 223 of the dielectric element 220. The first end of the feed conductor, which is located in that end of the top surface that faces the second side surface 222 is connected to an antenna port (not illustrated) by an intermediate conductor 235. In this example, the feed conductor includes four right-angled bends, so that there is formed a pattern resembling a frame that is open at one corner. Substantial feature is the electric length of the feed conductor. According to the invention, said length is arranged to be such that the resonance frequency of the feed conductor is fairly near to the resonance frequency of the dielectric resonator, so that the frequency bands corresponding to said two resonance frequencies form a united operation band. Naturally the width of a band formed by means of twin resonances is larger than the bandwidth of a dielectric resonator alone.

In this specification and in the appended claims, the "bottom surface" of an element means that surface of the element that falls against the circuit board. Respectively, the "top surface" of an element means the surface that is opposite to the "bottom surface". Thus the terms "top surface", "bottom surface" and "side surface" have nothing to do with the usage positions of the device in question.

FIG. 3 discloses an example of the frequency characteristics of an antenna according to the invention. The result applies for the structure illustrated in FIG. 2, when the ground plane GND does not extend to below the dielectric element 220. In the drawing, there is a curve 31 of the reflection coefficient S11 as a function of the frequency. Between the frequencies 2.2 GHz and 2.3 GHz, there is a resonance peak caused by the dielectric resonator. Around the frequency 2.5 GHz, there is another resonance peak caused by the feed conductor. In the curve it is seen that when using the value −6 dB of the reflection coefficient as the criterion for the band edge, the operation band of the antenna is about 2.00 GHz–2.66 GHz. Consequently, the absolute bandwidth B is 660 MHz, and the relative bandwidth is 28%. This is roughly doubled in comparison with the values achieved by means of corresponding known antennas.

FIG. 4 illustrates, by using a Smith diagram, the quality of matching of the same antenna that was referred to in FIG. 3. The curve 41 shows how the complex reflection coefficient is changed as a function of the frequency. The circle 42, drawn by dotted lines, shows a limit inside which the magnitude of the reflection coefficient is smaller than 0.5, i.e. −6 dB. From the curve 41 it is seen that said antenna structure can still be improved. An optimal situation with respect to bandwidth is reached when the loop contained in the reflection coefficient curve is completely inside the circle 42.

FIGS. 3 and 4 illustrate measuring results. The radiation patterns obtained by simulation prove that as regards the directional characteristics, said exemplary structure is well suited to radio devices, the position of which is altered in a random way.

FIGS. 5*a* and *b* illustrates another example of the antenna structure according to the invention. FIG. 5*a* shows a perspective view of the antenna. Also in this case, the antenna structure includes a ground plane GND on the top surface of a circuit board 510 and a dielectric element 520 having the shape of a rectangular prism placed in the corner of said circuit board. In accordance with the structure illustrated in FIG. 2, the same two side surfaces are coated by a conductive material connected to the ground. The difference with FIG. 2 is that the top surface 523 of the dielectric element is not provided with the feed conductor of the dielectric resonator. In this example, the feed conductor 531 is on the bottom surface of the dielectric element. This is seen in FIG. 5*b*, where the dielectric element 520 is detached from the circuit board 510 and turned upside down, so that the bottom surface is visible. The feed conductor, which according to the invention also functions as a radiating resonator, now forms a Meander pattern in the longitudinal direction of the dielectric element. For the feed, one end of the Meander pattern is provided with a contact pad F2. When the dielectric element is installed in place, said contact pad F2 matches the feed pin F1 extending through the circuit board. (For the sake of simplicity, this specification only deals with the antenna feed. Naturally the antenna is a two-way antenna, which means that the feed pin also is a reception pin.)

In this example, the bottom surface of the dielectric element 520 also is provided with a parasitic conductor 532. When the dielectric element is installed in place, the other end of the parasitic conductor matches an extension of the ground plane on the circuit board, so that said other end of the parasitic element is connected to ground.

FIG. 6 illustrates a third example of the antenna structure according to the invention. The antenna structure 600 comprises a ground plane GND and a dielectric element 620. In the dielectric element, the corresponding two side surfaces 621 and 622, as in the structure of FIG. 2, are coated with a conductive material connected to ground. The difference with the structures of FIGS. 2 and 5*a, b* is that the antenna feed conductor 631 now is located on the uncoated side surfaces of the dielectric element. In this example the first part of the feed conductor, is located on the side surface that is opposite to the second side surface 622, and the second part is located on the surface opposite to the first side surface 621. According to the invention the feed conductor at the same time serves as a radiating conductor.

FIG. 7 illustrates a fourth example of the antenna structure according to the invention. The antenna structure 700 comprises a ground plane GND and a dielectric element 720. In the dielectric element, the corresponding two side surfaces 721 and 722, as in the structure of FIG. 2, are coated with a conductive material connected to ground, with the difference that the first side surface 721 is coated only partly. In this example the feed conductor 731, which according to the invention at the same time serves as a radiating conductor, is located in the uncoated area of the first side surface 721.

FIG. 8 illustrates a radio device MS, for instance a mobile phone. Inside the radio device, there is a circuit board 810, the top surface whereof is ground plane, at least for the major part. In the corner of the circuit board, there is arranged a dielectric antenna 800 according to the invention.

Above it has been described some antenna structures according to the invention. The antenna structure may deviate from those described. The shape of the dielectric element, as well as the shape of the feed conductor, may vary greatly. The fastening of the feed conductor onto the surface of the dielectric element may be carried out in many different ways; the conductor can for instance be made of adhesive and electroconductive plastic. The feed conductor can also be formed inside the dielectric element already at the production phase thereof. The invention does not in any way restrict the manufacturing manner of the antenna. Thus the inventive idea can be applied in many different ways within the scope defined in the independent claim 1.

What is claimed is:

1. A dielectric antenna comprising:

an open dielectric resonator having a dielectric element, which is open on at least two sides so as to emit radiation;

a ground plane; and a feed conductor having only one connection point;

said connection point being connected to an antenna port;

wherein the feed conductor is arranged to guide an electromagnetic field to the dielectric resonator and to resonate in an operation band of said antenna, and wherein the dielectric element is a solid block.

2. An antenna according to claim 1, side surfaces of the dielectric element being partly coated with a conductive layer galvanically connected to the ground plane.

3. An antenna according to claim 1, wherein the frequency bands corresponding to resonance frequency of the feed conductor and to resonance frequency of the dielectric resonator form a united operation band for the antenna.

4. An antenna according to claim 1, wherein the frequency bands corresponding to resonance frequency of the feed conductor and to resonance frequency of the dielectric resonator form two separate operation bands for the antenna.

5. An antenna according to claim 1, said feed conductor being located on the top surface of the dielectric element.

6. An antenna according to claim 1, said feed conductor being located on the bottom surface of the dielectric element.

7. An antenna according to claim 1, said feed conductor being located on at least one side surface of the dielectric element.

8. An antenna according to claim 7, said at least one side surface of the dielectric element being partly coated with a conductive layer galvanically connected to the ground plane.

9. An antenna according to claim 1, said feed conductor being a strip conductor.

10. An antenna according to claim 1, further comprising at least one parasitic conductor element.

11. An antenna according to claim 9, said strip conductor being made of electroconductive plastic.

12. A dielectric antenna comprising:

an open dielectric resonator having a dielectric element, which is open on at least two sides so as to emit radiation;

a ground plane; and a feed conductor;

said feed conductor being a strip conductor meander element;

wherein the feed conductor is arranged to guide an electromaanetic field to the dielectric resonator and to resonate in an operation band of said antenna.

13. A radio device having a dielectric antenna comprising:

an open dielectric resonator, which is open on at least two sides so as to emit radiation;

a feed conductor having only one connection point;

said connection point being connected to an antenna port; and the feed conductor being arranged to guide an electromagnetic field to the dielectric resonator and to resonate in an operation band of said antenna;

wherein the dielectric element is a solid block.

14. A dielectric antenna comprising:

an open dielectric resonator having a dielectric element and a ground plane;

the dielectric resonator being open on at least two sides so as to emit radiation;

a feed conductor having only one connection point;

said connection point being connected to an antenna port; and the feed conductor arranged to guide an electromagnetic field to the dielectric resonator and to resonate in an operation band of said antenna;

wherein frequency bands corresponding to a resonance frequency of the feed conductor and a resonance frequency of the dielectric resonator form two separate operation bands for the antenna, and wherein the dielectric element is a solid block.

15. An antenna according to claim 14, wherein side surfaces of the dielectric element, being partly coated with a conductive layer, are electrically connected to the ground plane.

16. An antenna according to claim 14, further comprising at least one parasitic conductor element.

17. A dielectric antenna comprising:

an open dielectric resonator having a dielectric element, which is open on at least two sides so as to emit radiation;

a ground plane; and a feed conductor;

said feed conductor being a strip conductor meander element positioned at least one of on and in said dielectric element;

wherein the feed conductor is arranged to guide an electromagnetic field to the dielectric resonator and to resonate in an operation band of said antenna.

18. A dielectric antenna comprising:

an open dielectric resonator having a dielectric element, which is open on at least two sides so as to emit radiation;

a ground plane;

a feed conductor having only one connection point;

said connection point being connected to an antenna port;

the feed conductor being arranged to guide an electromagnetic field to the dielectric resonator and to resonate in an operation band of said antenna; and said feed conductor being positioned at least one of on and in said dielectric element;

wherein the dielectric element is a solid block.

19. An antenna according to claim 18, side surfaces of the dielectric element being partly coated with a conductive layer galvanically connected to the ground plane.

20. An antenna according to claim 18, wherein the frequency bands corresponding to resonance frequency of the feed conductor and to resonance frequency of the dielectric resonator form a united operation band for the antenna.

21. An antenna according to claim 18, wherein the frequency bands corresponding to resonance frequency of the feed conductor and to resonance frequency of the dielectric resonator form two separate operation bands for the antenna.

22. An antenna according to claim 18, said feed conductor being a strip conductor.

23. An antenna according to claim 18, further comprising at least one parasitic conductor element.

24. An antenna according to claim 22, said strip conductor being made of electroconductive plastic.

* * * * *